US005268248A

United States Patent [19]

Tanikawa et al.

[11] Patent Number: 5,268,248

[45] Date of Patent: Dec. 7, 1993

[54] TONER FOR DEVELOPING ELECTROSTATIC IMAGE AND PROCESS FOR PRODUCTION THEREOF

[75] Inventors: Hirohide Tanikawa, Yokohama; Masaki Uchiyama, Ichikawa; Yoshinobu Joh, Kawasaki; Yasutaka Akashi, Yokohama; Masaaki Taya, Kawasaki; Makoto Unno, Tokyo; Kazuyoshi Hagiwara, Yokohama, all of Japan

[73] Assignee: Canon Kabushiki Kaisha, Tokyo, Japan

[21] Appl. No.: 798,643

[22] Filed: Nov. 26, 1991

[30] Foreign Application Priority Data

Nov. 30, 1990 [JP] Japan ..... 2-333830

[51] Int. Cl.[5] ..... G03G 9/087; G03G 9/09; G03G 9/097

[52] U.S. Cl. ..... 430/106; 430/106.6; 430/110; 430/111

[58] Field of Search ..... 430/110, 111, 106, 106.6

[56] References Cited

U.S. PATENT DOCUMENTS

| | | | |
|---|---|---|---|
| 2,297,691 | 10/1942 | Carlson . | |
| 3,666,363 | 5/1972 | Tanaba et al. . | |
| 4,071,361 | 1/1978 | Marushima . | |
| 4,158,634 | 6/1979 | Amariti et al. | 430/137 |
| 4,565,763 | 1/1986 | Uchiyama et al. | 430/109 |
| 4,565,766 | 1/1986 | Mitsuhashi et al. | 430/126 |
| 4,952,476 | 8/1990 | Sakashita et al. | 430/106.6 |
| 4,966,829 | 10/1990 | Yasuda et al. | 430/109 |

FOREIGN PATENT DOCUMENTS

| | | |
|---|---|---|
| 331393 | 9/1989 | European Pat. Off. . |
| 393592 | 10/1990 | European Pat. Off. . |
| 56-16144 | 2/1981 | Japan . |
| 56-158340 | 12/1981 | Japan . |
| 57-86558 | 5/1982 | Japan . |
| 60-166958 | 8/1985 | Japan . |
| 63-223662 | 9/1988 | Japan . |
| 1-172843 | 7/1989 | Japan . |
| 1-172844 | 7/1989 | Japan . |

OTHER PUBLICATIONS

Patent Abstracts of Japan, vol. 14, No. 415 (P-1102) [4358] Sep. 7, 1990.

*Primary Examiner*—Roland Martin

*Attorney, Agent, or Firm*—Fitzpatrick, Cella, Harper & Scinto

[57] ABSTRACT

A toner for developing an electrostatic image is provided as a pulverized mixture including a binder resin and a colorant. The binder resin is characterized by a molecular weight distribution on a GPC chromatogram of its tetrahydrofuran (THF)-soluble resin content including below 15% of a resin component in a molecular weight region of at most 5000 and at least 5 wt. % of a resin component in a molecular weight region of at least $5\times10^6$ and showing a main peak in a molecular weight region of 5000 to $5\times10^6$. The THF-soluble resin component in the molecular weight region of at least $5\times10^6$ is extremely enriched during a melt-kneading step during the toner production, so as to effectively prevent toner flowout from a member for cleaning a fixing roller.

41 Claims, 2 Drawing Sheets

TONER FOR DEVELOPING ELECTROSTATIC IMAGE AND PROCESS FOR PRODUCTION THEREOF

FIELD OF THE INVENTION AND RELATED ART

The present invention relates to a toner for developing electrostatic images used in image forming methods, such as electrophotography or electrostatic printing, and a process for production thereof, particularly a toner suitable for hot roller fixation and a process for production thereof.

Hitherto, a large number of electrophoto-graphic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., as desired, fixed by heating, pressing, or heating and pressing, or with solvent vapor to obtain a copy.

As for the step of fixing the toner image onto a sheet material such as paper which is the final step in the above process, various methods and apparatus have been developed, of which the most popular one is a heating and pressing fixation system using hot rollers.

In the heating and pressing system, a sheet carrying a toner image to be fixed (hereinafter called "fixation sheet") is passed through hot rollers, while a surface of a hot roller having a releasability with the toner is caused to contact the toner image surface of the fixation sheet under pressure, to fix the toner image. In this method, as the hot roller surface and the toner image on the fixation sheet contact each other under a pressure, a very good heat efficiency is attained for melt-fixing the toner image onto the fixation sheet to afford quick fixation, so that the method is very effective in a high-speed electrophotographic copying machine. In this method, however, a toner image in a melted state is caused to contact a hot roller surface under pressure, so that there is observed a so-called offset phenomenon that a part of the toner image is attached and transferred to the hot roller surface and then transferred back to the fixation sheet to stain the fixation sheet. It has been regarded as one of the important conditions in the hot roller fixation system to prevent the toner from sticking to the hot roller surface.

In order to prevent a toner from sticking onto a fixing roller surface, it has been conventionally practiced to compose the roller surface of a material showing excellent releasability against the toner (e.g., silicone rubber or fluorine-containing resin) and further coating the surface with a film of a liquid showing a good releasability such as silicone oil so as to prevent offset and fatigue of the roller surface. This method is very effective for preventing offset but requires a device for supplying such an offset-preventing liquid, thus resulting in complication of the fixing apparatus.

Therefore, it is not necessarily desirable to prevent the offset by supplying an offset-preventing liquid, but a toner having a broad fixing temperature range and excellent in anti-offset characteristic is rather desired at present. For this reason, in order to provide a toner with an increased releasability, it has been also practiced to add a wax, such as low-molecular weight polyethylene or low-molecular weight polypropylene. The use of wax is effective in prevention of offset but on the other hand is liable to provide the toner with an increased agglomerability, an unstable chargeability and a deterioration in durability. Therefore, various proposals have been made for improving the binder resin.

For example, it is known to increase the glass transition temperature (Tg) and the molecular weight of a toner binder resin so as to improve the molten viscoelasticity of the toner for the purpose of offset prevention. According to this method, however, the improvement in anti-offset characteristic leads to an insufficient fixability, thus resulting in an inferiority in low-temperature fixability (i.e., fixability at a low temperature) as required in a high-speed copying machine or for economization of energy consumption.

On the other hand, in order to improve the fixability of a toner, it is necessary to lower the viscosity of the toner in a molten state so as to increase the area of adhesion with a substrate on which the toner is fixed. For this reason, it is required to lower the Tg and molecular weight of the binder resin used.

In this way, the low-temperature fixability and the anti-offset characteristic are contradictory in some respects, so that it is very difficult to develop a toner satisfying these properties in combination.

In order to solve the above problems, for example, Japanese Patent Publication (JP-B) 51-23354 has proposed a moderately crosslinked vinyl polymer by addition of a crosslinking agent and a molecular weight controller, and JP-B 55-6805 has proposed a toner composed from an $\alpha,\beta$-ethylenically unsaturated monomer and having a broad molecular weight distribution represented by a weight-average molecular weight/number-average molecular weight ratio of 3.5–40. It has been also proposed to use a resin blend including a vinyl copolymer having specified Tg, molecular weight and gel content.

The toners by these proposals actually provide a fixable temperature range (defined as a difference between the offset-initiation temperature and the lowest fixable temperature) which is wider than that of a toner comprising a single resin having a narrow molecular weight distribution. However, when provided with a sufficient offset-prevention characteristic, the toners cannot provide a sufficiently low fixation temperature. On the other hand, if the low-temperature fixability is thought much of, the offset-prevention performance is liable to be insufficient.

For example, Japanese Laid-Open Patent Application (JP-A) 56-158340 has proposed a toner binder resin comprising a low-molecular weight polymer and a high-molecular weight polymer. It is practically difficult to have the binder resin contain a crosslinked component. Accordingly, in order to provide a high level of anti-offset characteristic, it is necessary to increase the molecular weight of the high-molecular weight polymer or increase the proportion of the high-molecular weight polymer. This is liable to remarkably impair the pulverizability of the binder resin and thus it is difficult to obtain a practically satisfactory product. Further, as for a toner comprising a blend of a low-molecular weight polymer and a crosslinked polymer, JP-A 58-86558 has proposed a toner comprising a low-molecular weight polymer and an insoluble and infusible high-molecular weight polymer as principal resin components. According to the teaching, the toner fixability and the pulverizability of the binder resin may actually be improved. However, as the low-molecular weight polymer has a weight-average molecular weight/number-average molecular weight (Mw/Mn) ratio which is as small as at most 3.5 and the insoluble and infusible high-molecular weight polymer is contained in a large proportion of 40–90 wt. %, it is difficult to satisfy the anti-offset characteristic of the toner and the pulverizability of the resin at high levels in combination. It is therefore very difficult to provide a toner with sufficient fixability and anti-offset characteristic unless it is used with a fixing apparatus equipped with an anti-offset liquid supplier. Further, if the insoluble and infusible high-molecular weight polymer is used in a large proportion, the binder resin shows a very high melt-viscosity in a melt-kneading step for toner production, so that it is necessary to effect the melt-kneading at a temperature which is much higher than ordinary cases. As a result, the additives to the toner are liable to cause thermal decomposition to lower the toner performances.

JP-A 60-166958 has proposed a toner comprising a resin component prepared by polymerization in the presence of a low-molecular weight poly-α-methylstyrene having a number-average molecular weight (Mn) of 500–1,500. The same patent specification describes that an Mn range of 9,000–30,000 is preferred but a higher Mn for improving the anti-offset characteristic leads to practical problems in fixability and pulverizability of the resin composition at the time of toner production. Such a resin composition showing a poor pulverizability leads to a decrease in productivity in toner production and mingling of coarse particles in the product toner, thus being liable to result in scattered images.

JP-A 56-16144 has proposed a toner comprising a binder resin having at least a maximum in each of the molecular weight ranges of $10^3-8\times10^4$ and $10^5-2\times10^6$ in the molecular weight distribution according to GPC (gel permeation chromatography). The toner exhibits excellent performances with respect to pulverizability, anti-offset characteristic, fixability, anti-filming or anti-melting characteristic on a photosensitive member and image forming characteristic but further improvement in anti-offset characteristic and fixability is desired. Particularly, it is difficult by employing such resin to further improve the fixability while maintaining or even improving the other performances so as to meet strict demands in these days.

As described above, it is very difficult to realize high performances with respect to both fixing performances (low-temperature fixability and anti-offset characteristic) of the toner and pulverizability during toner production. In particular, the pulverizability in toner production is an important factor in view of a direction of recent demands for a smaller toner size so to realize high quality, high resolution and excellent thin-line reproducibility. The improvement in pulverizability is also important with respect to economization of energy consumption as the pulverization step requires a very high energy. Meltsticking of a toner material onto an inside wall of a pulverization apparatus is also a problem which is sometimes encountered with a toner showing a good fixability, thus giving rise to a poor pulverization efficiency in some cases.

As another aspect, a cleaning step is employed in excess copying cycle so as to remove a toner on a photosensitive member after a transfer step in another copying cycle. Nowadays, it is conventional adopt a blade cleaning system so as to provide a compact and light apparatus and in view of its reliability. Along with achievement of a photosensitive member with an extended life, a photosensitive drum with a smaller diameter and a high speed system, anti-sticking and anti-filming properties against a photosensitive member are strictly demanded of the toner. Particularly, an amorphous silicon photosensitive member recently developed has a high durability and an OPC (organic photoconductor) photosensitive member is also provided with an extended life, so that higher performances are accordingly required of the toner.

In order to provide a compact apparatus, it is necessary to adequately dispose various parts in narrow spaces. Accordingly, little space is left for passing cooling air. Further, a heat-generating source such as a fixer is disposed closer to a toner hopper and a cleaner, so that the toner tends to be exposed to a high temperature atmosphere. For this reason, a toner cannot be practically used unless it has an excellent anti-blocking characteristic.

In order to solve the above-mentioned problems, our research group has proposed the use of a special resin which has been prepared by adding a low-molecular weight resin during suspension polymerization (JP-A 63-223662). Even a toner prepared according to this proposal cannot show a sufficient fixability when used in a high-speed copying machine operated at a high speed of 80 or more A4-size sheets/minute. Such a toner is found to flowout through a cleaning member abutting the fixing roller, and thus is liable to stain the transfer material such as paper.

In a high-speed machine exceeding 80 sheets/min, even if an offset amount per sheet is very slight, a considerable amount of offset residue can be accumulated on the fixing roller due to a large number of sheets passing therethrough, so that the fixing apparatus can cause a problem thereby. In order to remove the slight amount of offset residue, a fixer cleaning member such as a silicone rubber-made cleaning roller or a web is disposed abutting to the fixing roller. A conventional toner binder resin has been designed so as to provide a low-temperature fixability and an anti-offset characteristic and has not been desired so as to provide a high melt-viscosity even at as high a temperature as exceeding 200° C. Further, the toner material attached to the fixer cleaning member remains for a long period at a set temperature of the fixing roller and causes a lowering in melt viscosity. As a result, when the fixing roller temperature exceeds 200° C. due to overshooting in excess of the set temperature thereof, e.g., at the time of turning on the copying apparatus, the attached toner material causes a remarkable decrease in melt viscosity and is thus re-transferred to the fixing roller to stain the toner image-receiving sheet.

JP-A 1-172843 and JP-A 1-172844 have proposed toners which have peaks in molecular weight ranges of $3\times10^3$–$5\times10^3$ and $1.5\times10^5$–$2.0\times10^6$ and have a peak area percentage of 40–60% in a molecular weight region of $1.5\times10^5$–$2\times10^6$ or a gel content of 1–10%. These toners are actually satisfactory for low-speed or medium-speed apparatus but do not fully satisfy anti-offset characteristic or fixability required in a high-speed apparatus.

As has been described above, various performances required of a toner are mutually contradictory in many cases, and it has been also required to satisfy them in combination at high levels in recent years.

SUMMARY OF THE INVENTION

An object of the present invention is to provide a toner having solved the above-mentioned problems and a process for production thereof.

An object of the present invention is to provide a toner which can be fixed at a low temperature and does not cause toner flowout from a fixer cleaning member, and a process for production thereof An object of the present invention is to provide a toner which can be fixed at a low temperature and does not cause melt-sticking or filming onto a toner-carrying member or a photosensitive member even in a high-speed system, and a process for production thereof.

An object of the present invention is to provide a toner excellent in successive copying characteristic on a large number of sheets, and a process for production thereof.

An object of the present invention is to provide a toner which can be fixed at a low temperature and has a excellent anti-blocking characteristic, thus being able to be adequately used in a high temperature atmosphere of a small-size apparatus, and a process for production thereof.

An object of the present invention is to provide a toner which can be fixed at a low temperature and can be produced effectively and continuously without causing melt-sticking of pulverization product onto an inside wall of a pulverization apparatus.

An object of the present invention is to provide a toner which forms in little coarse powder at the time of producing toner particles because of good pulverizability and causes little scattering around a toner image during development, thus being capable of stably providing good developed images, and a process for production thereof.

An object of the present invention is to provide a toner which can be produced with good pulverizability but without being accompanied with ultra-fine powder due to over-pulverization and thus can stably form good developed images, and a process for production thereof.

An object of the present invention is to provide a toner which can be produced through efficient pulverization and classification without occurrence of coarse powder and ultra-fine powder and thus shows a good productivity.

A further object of the present invention is to provide a toner which is excellent in anti-blocking characteristic and free from agglomeration in circulation and storage, thus being excellent in storability, and a process for production thereof.

According to the present invention, there is provided a toner for developing an electrostatic image, comprising: a binder resin and a colorant, wherein the binder resin shows a molecular weight distribution on a GPC chromatogram of its tetrahydrofuran (THF)-soluble resin content including below 15% of a resin component in a molecular weight region of at most 5000 and at least 5 wt. % of a resin component in a molecular weight region of at least $5\times10^6$ and showing a main peak in a molecular weight region of 5000 to $10^5$.

According to another aspect of the present invention, there is provided a process for producing a toner, comprising:

mixing a resin composition, a colorant and an organic metal compound to obtain a mixture, the resin composition containing a crosslinkage formed with a crosslinking agent having at least two vinyl groups and a carboxyl group;

heating said mixture;

melt-kneading the heated mixture while exerting a shearing force to the mixture, so as to sever molecular chains of a high molecular weight component in the resin composition under the action of the shearing force and form an electrostatic linkage between the carboxylic group and the organic metal compound or a metal ion in the organic metal compound under heating;

cooling the resultant kneaded product;

pulverizing the cooled kneaded product; and classifying the resultant pulverized product to obtain a toner;

said toner comprising binder resin and a colorant; wherein the binder resin shows a molecular weight distribution on a GPC chromatogram of its tetrahydrofuran (THF)-soluble resin content including below 15% of a resin component in a molecular weight region of at most 5000 and at least 5 wt. % of a resin component in a molecular weight region of at least $5\times10^6$ and showing a main peak in a molecular weight region of 5000 to $10^5$.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
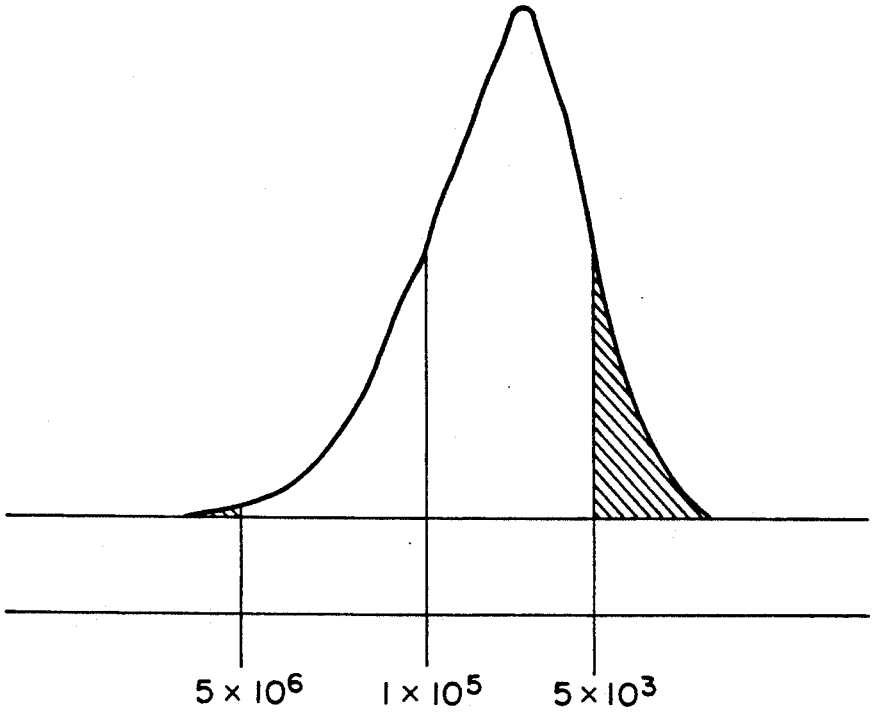
FIG. 1 is a GPC (gel permeation chromatography) chromatogram of a resin composition A.

First of all, the binder resin used in the toner of the present invention will be described.

The molecular weight distribution of the THF (tetrahydrofuran)-soluble content of a binder resin or other resins used in the present invention may be measured based on a chromatogram obtained by GPC (gel permeation chromatography) in the following manner.

A GPC sample is prepared as follows.

A resinous sample is placed in THF and left standing for several hours (e.g., 5–6 hours). Then, the mixture is sufficiently shaked until a lump of the resinous sample disappears and then further left standing for more than 12 hours (e.g., 24 hours) at room temperature. In this instance, a total time of from the mixing of the sample with THF to the completion of the standing in THF is taken for at least 24 hours (e.g., 24–30 hours). Thereafter, the mixture is caused to pass through a sample treating filter having a pore size of 0.45–0.5 micron (e.g., "Maishoridisk H-25-5", available from Toso K.K.; and "Ekikurodisk 25CR", available from German Science Japan K.K.) to recover the filtrate as a GPC sample. The sample concentration is adjusted to provide a resin concentration within the range of 0.5–5 mg/ml.

The binder resin contained in the toner of the present invention may preferably have a THF-insoluble resin content, as recovered by the above filter treatment, of at most 10 wt. %, further preferably at most 5 wt. % most preferably substantially zero, as measured at a concentration of 5 mg/ml at room temperature, so as to exhibit the effect of the present invention.

In the GPC apparatus, a column is stabilized in a heat chamber at 40° C., tetrahydrofuran (THF) solvent is caused to flow through the column at that temperature at a rate of 1 ml/min., and about 100 μl of a GPC sample solution is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights in the range of about $10^2$ to $10^7$ available from, e.g., Toso K.K. or Showa Denko K.K. It is appropriate to use at least 10 standard polystyrene samples. The detector may be an RI (refractive index) detector. For accurate measurement, it is appropriate to constitute the column as a combination of several commercially available polystyrene gel columns. A preferred example thereof may be a combination of Shodex KF-801, 802, 803, 804, 805, 806, 807 and 800P; or a combination of TSK gel G1000H ($H_{XL}$), G2000H ($H_{XL}$), G3000H ($H_{XL}$), G4000H (HXL), G5000H ($H_{XL}$), G6000H ($H_{XL}$), G7000H ($H_{XL}$) and TSK guard-column available from Toso K.K.

The contents of a component having a molecular weight of 5000 or below and a component having a molecular weight of $5\times10^6$ or above on a GPC chromatogram are measured by calculating ratios of the integrated values of a molecular weight region of 5000 or below and a molecular weight region of $5\times10^6$ or above, respectively, to the integrated value of the entire molecular weight region of a sample resin. Alternatively, it is possible to measure the content of a component having a molecular weight of 5000 or below (or $5\times10^6$ or above) by cutting out a GPC chromatogram of the corresponding molecular weight region and calculating a ratio of the weight thereof to that of a GPC chromatogram covering the entire molecular weight region.

Figure 2:
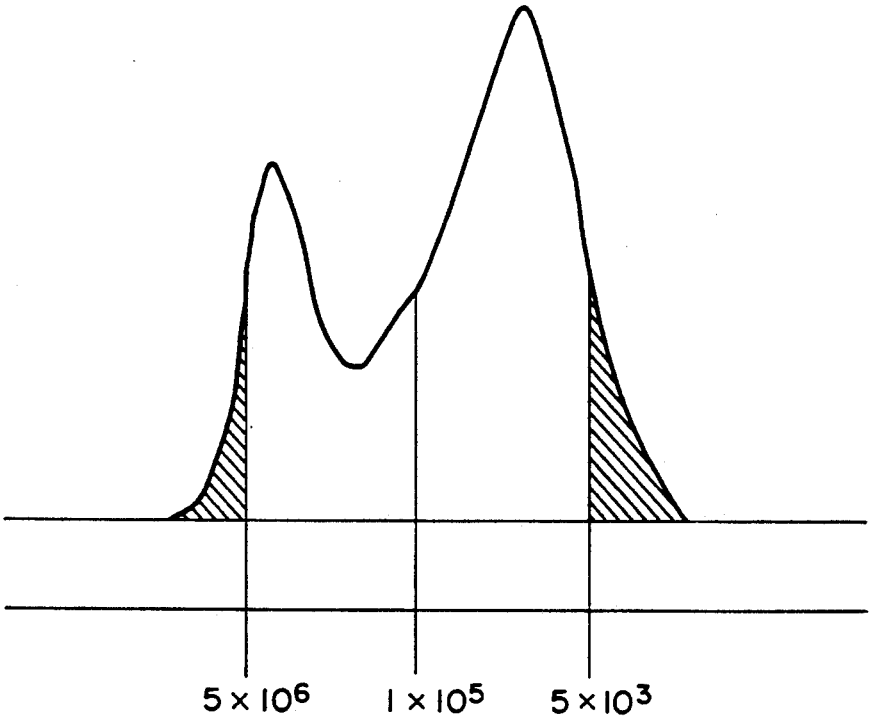
FIG. 2 is a GPC chromatogram of a resin composition obtained by kneading the resin composition A.
Figure 3:
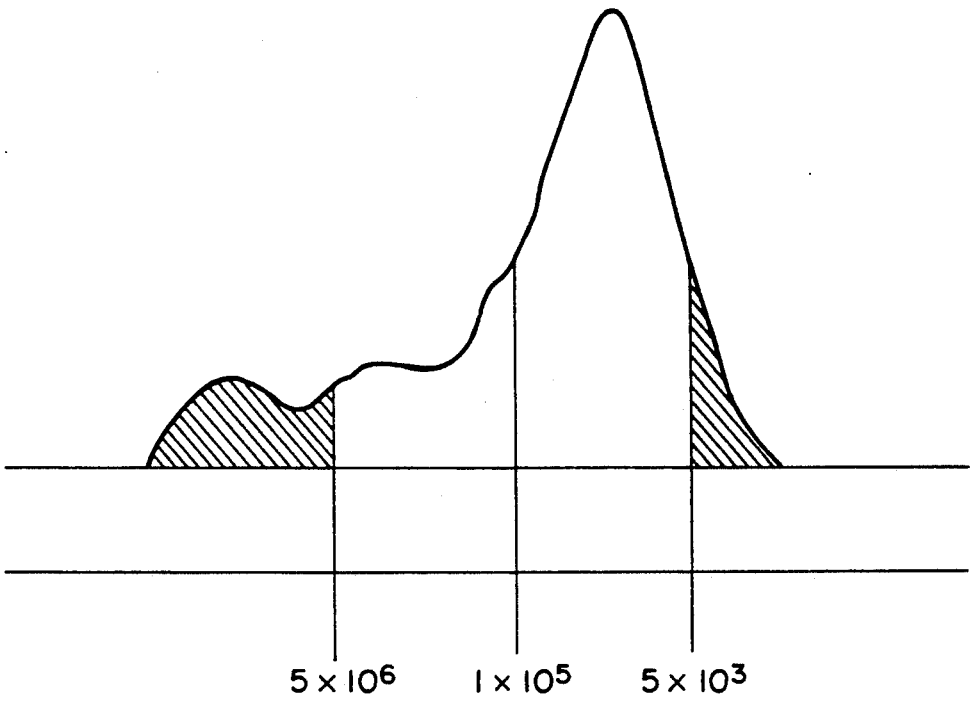
FIG. 3 is a GPC chromatogram of a resin composition obtained by kneading the resin composition A and an organic metal compound.

More specifically, for example, by measuring the areal or weight proportion of hatched portions in GPC chromatogram shown in FIGS. 1-3, the content of resin components having molecular weights of at most 5000 and at least $5\times10^6$ may be respectively obtained.

The binder resin of the present invention is characterized by containing below 15%,, preferably 2-14%, further preferably 3-13%, of a resin component having a molecular weight of at most 5000 in terms of molecular weight distribution based on the GPC chromatogram, whereby the resultant toner is provided with an improved anti-blocking characteristic, freeness from melt-sticking onto a pulverizer inner wall during production, freeness from melt-sticking or filming onto a toner-carrying member or a photosensitive member, and an improved storability.

Further, the toner binder resin prevents excessive pulverization to suppress occurrence of ultra-fine powder and coarse powder and increase the production efficiency at the time of toner production, and further provides a toner showing a good developing characteristic.

The resin component having a molecular weight of at most 5000 is liable to have a glass transition point (Tg) showing a noticeable molecular weight-dependence. Accordingly, if the resin component is contained in a large proportion, the binder resin is caused to show a thermal behavior as if it has a lower Tg than its ordinarily measured Tg and thus fails to fulfill the performance expected by the Tg.

For example, in a high-speed system in which the cleaning part on a photosensitive member evolves much heat of friction, melt-sticking and filming of the toner is liable to occur. Further, when the toner is continuously produced for a long time, melt-sticking of the pulverization product can occur inside the pulverizer. Further, the toner is liable to cause agglomeration in a toner container during the storage or transportation thereof. This is because the anti-blocking characteristic of the toner becomes inferior when the resin component having a molecular weight of at most 5000 is contained in a large proportion, and the toner receives a considerable weight of the toner per se when it stands in a large toner container as large as a capacity of 1 kg.

The resin component having a molecular weight of at most 5000 has a function of providing a melt-kneaded product with a particularly improved pulverizability at the time of toner production. It also provides an excessive pulverizability in production of a toner which results in much ultra-fine powder and a lower classification efficiency leading to a lower productivity, if it is contained excessively. A toner containing insufficiently classified ultra-fine powder is caused to have a gradually increased content of such ultra-fine powder through repetition of toner replenishment, and the increased ultra-fine powder is attached to a triboelectric toner-charging member due to an electrostatic force to hinder the triboelectric charging of the toner, thus causing a lowering in image density and fog.

On the other hand, such a resin component having a molecular weight of at most 5000 has been used hitherto in order to improve the pulverizability required for toner production and assist the improvement in toner fixability by partially lowering the toner viscosity. Accordingly, such a component can be contained and such effects can be expected if it is contained in at least 2%.

The toner binder resin used in the present invention is characterized by containing a resin component having a molecular weight of at least $5\times10^6$ in a proportion of at least 5%, preferably 7-30%, particularly preferably 8-25%. The resin component having a molecular weight of at least $5\times10^6$ shows excellent releasability and appropriately suppresses the fluidity of the toner at a high temperature, so that the component effectively functions to improve the anti-offset characteristic and prevents the toner flowout from the fixer cleaning member. A conventional toner contains little of the component so that it fails to effectively prevent the toner flowout.

If the resin component having a molecular weight of at least $5\times10^6$ is below 5%, the toner flowout-prevention characteristic is liable to be insufficient. In excess of 30%, the toner cannot be readily deformed on melting to inhibit the fixing, and also the component in a suitable molecular weight region for fixing is relatively decreased to again inhibit the improvement in fixability.

As a conventional technique, it has been known to incorporate in a binder resin a gel component (i.e., a component which cannot pass a screen of 80 mesh or 200 mesh when the binder resin is dissolved or dispersed in toluene because of a dense crosslinked network structure or large molecular weight) so as to provide the toner with a rubber elasticity. The THF-soluble resin component having a molecular weight of at least $5\times10^6$ used in the present invention has a larger crosslinked network structure and less crosslinkage than such a gel component, so that the polymer molecules are in a rather mobile state and do not excessively resist the deformation of the toner or hinder the fixation.

It is preferred that a resin component having a molecular weight in the range of $10^5$ to $5\times10^6$ is at most 35%, particularly 10–30%.

The component in this molecular weight region functions as a component effective for improving the anti-offset characteristic resisting a high-temperature offset (toner sticking onto fixing rollers at a high temperature) but shows little effect of preventing the toner flowout even if it is contained in a larger amount. On the other hand, the above-mentioned component having a molecular weight of at least $5\times10^6$ is essential and shows a large effect for preventing the toner flowout.

Thus, the component in the molecular weight range of $10^5$ to $5\times10^6$ is not a component for improving the fixability nor is it a component for preventing the toner flowout. Accordingly, the component need not be contained in a large proportion.

The resin component having a molecular weight in the range of $10^5$ to $5\times10^6$ principally functions as a component linking a medium molecular weight component and the ultra-high molecular weight component having a molecular weight of at least $5\times10^6$ and functions to uniformize the anti-offset component and the fixing component in the binder resin and aid the dispersion of internal additives to the toner, such as a colorant and a charge control agent in the toner. For this reason, it is preferred that the resin component in this molecular weight range is contained in a proportion of 10–30%. In a conventional toner, the component having a molecular weight of $10^5$ to $5\times10^6$ has been used to provide an anti-offset characteristic. The component is actually effective for preventing offset but does not effectively work for preventing the toner flowout.

The binder resin of the present invention is characterized by showing a main peak (the highest peak) in a molecular weight region of 5000 to $10^5$, particularly in a region of 104 to $5\times10^4$ In case where there are several peaks, it is also preferred that a sub-peak having a height which is a half or more of that of the main peak is in the molecular weight range of $5000\propto10^5$.

A component having a molecular weight of at most $10^4$ functions as a component for improving the pulverizability of a toner material at the time of toner production, and the component in the molecular weight region of 5000–$10^5$ is a component for improving the fixability of the toner.

In order to incorporate these components in the binder resin in a large proportion and in a good balance, the binder resin is required to show a main peak in the above-mentioned molecular weight region. As a result, it is possible to attain a good pulverizability of the toner material in toner production and also a good fixability of the toner. So as to be a measure component, the component in the molecular weight region of 5000 to $10^5$ may preferably be contained in a proportion of at least 40%, further preferably at least 45%. It is also a preferred mode that a single peak in this region is present in the region of 104 to $5\times10^4$.

If the main peak is at a molecular weight of below 5000, the same difficulties as in the above-mentioned case of the component having a molecular weight of at most 5000 being 15% or more are encountered. If the main peak is present at a molecular weight in excess of $10^5$, it becomes impossible to attain a sufficient fixability and pulverizability. As the molecular weight giving the main peak exceeds about $5\times10^4$, the pulverizability of the toner material begins to be gradually lowered.

A characteristic of the binder resin of the toner according to the present invention is that it has a weight-average molecular weight (Mw) of at least $5\times10^6$, preferably $6\times10^6$–$2\times10^7$, as calculated based on its GPC chromatogram. If the Mw is at least $5\times10^6$, the molecular weight distribution covering the high-molecular weight region to the ultra high-molecular weight region is smoothly connected, and a resin component having a molecular weight of at least $5\times10^6$ effective for offset prevention is contained in a sufficient amount and in a sufficiently broad range. The Mw of at least $5\times10^6$ means not that a resin component having a molecular weight amount $5\times10^6$ is contained in a large proportion but that a resin component having a molecular weight in excess thereof is contained in a broad distribution. In other words, the GPC chromatogram shows not a high peak but shows a broad distribution around a molecular weight of $5\times10^6$ or above. As a result, an effective amount of a resin component functioning to connect with the other resin component is contained, so that the internal additives to the toner can be well dispersed. An Mw of below $5\times10^6$ can result in an insufficient anti-offset characteristic. On the other hand, an Mw exceeding $2\times10^7$ can cause a failure of toner fixation or dispersion of internal additives. It is further preferred that the binder resin has a number-average molecular weight (Mn) of at most $4\times10^4$, more preferably at most $3\times10^4$, particularly preferably $2.5\times10^4$, as calculated based on the GPC chromatogram, in order to contain effective amounts of fixability-enhancing component and pulverizability-improving component. So as to contain the above-mentioned respective components in a good balance and have the respective components effectively show their functions, the binder resin may preferably have a broad molecular weight distribution as represented by an Mw/Mn ratio of above 125, more preferably at least 170.

The binder resin may preferably contain an ultra-high molecular weight component having a function of toner flowout. For this purpose, the binder resin may preferably have a Z-average molecular weight (Mz) of at least $2\times10^7$ also based on the GPC chromatogram. In order that the ultra-high molecular weight component is contained in a good balance, the binder resin may preferably a Z-average molecular weight/weight-average molecular weight (Mz/Mw) ratio of at most 40, further preferably 5–30. In case where the Mz/Mw ratio exceeds 40, the ultra-high molecular weight component is contained but the proportion thereof is rather decreased, thus being liable to fail to show a sufficient effect of preventing toner flowout. On the other hand, if the crosslinked component removed by filtering for GPC sample preparation is increased, a sufficient fixability is liable to be impaired. If the Mz/Mw ratio is below 5, the THF-soluble content of the binder resin fails to show a sufficient broadness in the ultra-high molecular weight side, so that the balance between the toner flowout preventing effect and the toner fixability can be impaired.

The average molecular weights Mn, Mw and Mz referred to herein are based on GPC chromatograms obtained by GPC using a sample at a resin concentration of about 5 mg/ml in a high-speed liquid chromatograph ("150C", available from Waters Co.) and a combination of columns ("Shodex GPC KF-801, 802, 803, 804, 805, 806, 807 and 800P", available from Showa Denko K.K.). The integration for calculation of Mn, Mw and Mz was performed, e.g., at a retention time increment of about 0.3 min.

The binder resin used in the present invention may preferably have an acid value measured according to JIS K-0070 (hereinafter referred to as "JIS acid value" or simply as "acid value") of 2-100 mgKOH/g, more preferably 5-70 mgKOH/g. Because of its acid value, the binder resin provides a toner with an increased releasability with respect to the fixing rollers. If the acid value is below 2 mgKOH/g, it is difficult to cause re-crosslinking as described hereinafter sufficiently. If the acid value exceeds 100 mgKOH/g, it becomes difficult to effect the toner charge control, thus a fluctuation may be caused in the developing depending on environmental conditions. It is preferred that an acid value attributable to the acid anhydride group is at most 10 mgKOH/g, further preferably below 6 mgKOH/g. If the acid value attributable to the acid anhydride group exceeds 10 mgKOH/g, vigorous re-crosslinking is caused at the time of kneading which is liable to result in excessive crosslinkage and deterioration in fixability due to hindrance of movement of polymer molecule chains. Further, control of the degree of crosslinking in the binder resin becomes difficult. This is because the acid anhydride group is richer in reactivity than the other acid groups.

If the resin component having a molecular weight of at least $5\times10^6$ has an acid value, the polar group providing the acid group in the polymer chain can form a weak bond due to affinity given by a hydrogen bond with polar groups in magnetic material, pigment and/or dye internally added to the toner. Accordingly, it becomes possible to compatibly satisfy the toner flowout-prevention characteristic and fixability of the toner through moderate suppressing of the fluidity of the toner at a high temperature. If the acid anhydride group is contained excessively, the crosslinking is promoted to provide an insoluble content which cannot pass through the filter for preparing a GPC sample solution and thus cannot be observed on a GPC chromatogram.

In order to obtain a vinyl polymer having an acid anhydride group, the following methods for example may be used in addition to a conventional polymerization process using an acid anhydride monomer. In solution polymerization using a monomer, such as a dicarboxylic acid or a dicarboxylic acid monoester, it is possible to convert a part of the dicarboxylic acid groups or dicarboxylic acid monoester groups in the resultant vinyl (co)polymer into anhydride groups by adjusting the conditions for distilling off the solvent after the polymerization. It is also possible to convert such dicarboxylic acid groups and dicarboxylic acid monoester groups into anhydride groups by heat-treating the vinyl copolymer obtained by the bulk polymerization or solution polymerization. A part of such anhydride groups can be reacted with a compound such as an alcohol to be esterified.

Reversely, it is also possible to convert a part of such anhydride groups by ring-opening through hydrolysis of the vinyl copolymer obtained above into dicarboxylic acid groups.

On the other hand, dicarboxylic acid monoester groups of a vinyl copolymer obtained by suspension polymerization or emulsion polymerization using a vinyl monomer including such a dicarboxylic acid monoester group are converted into anhydride groups by heat-treatment or into dicarboxylic acid groups by hydrolysis. If such a vinyl copolymer obtained by bulk polymerization or solution polymerization is dissolved in a vinyl monomer and the resultant mixture is subjected to suspension polymerization or emulsion polymerization, a part of the anhydride groups can cause ring-opening to leave dicarboxylic acid groups in the polymer. In this instance, it is possible to mix another resin in the vinyl monomer. The resultant resin can be treated by heating, weak alkaline water or an alcohol for anhydrization, ring-opening or esterification.

A vinyl monomer having a dicarboxylic acid group and a vinyl monomer having a dicarboxylic anhydride group have a strong tendency to form an alternating copolymer. For this reason, in order to obtain a vinyl copolymer containing functional groups, such as anhydride groups or dicarboxylic acid groups, at random positions therein, it is possible to adopt as a suitable one a polymerization method using a dicarboxylic acid monoester. A binder resin obtained through polymerization using a dicarboxylic acid monoester contains carbonyl groups, anhydride groups and/or dicarboxylic acid groups therein so that a uniform crosslinking can be caused therein.

The formation or extinction of an anhydride group in a polymer may be confirmed by an IR analysis because an anhydride group provides an IR absorption peak which has been shifted from those of the corresponding acid group and ester group toward a higher wave number side.

The acid value attributable to an acid anhydride group may for example be measured by combining the JIS acid value measurement and the acid value measurement through hydrolysis (total acid value measurement).

For example, the JIS acid value measurement provides an acid value of an acid anhydride which is about 50% of the theoretical value (based on an assumption that a mol of an acid anhydride provides an acid value identical to the corresponding dicarboxylic acid).

On the other hand, the total acid value measurement provides an acid value which is almost identical to the theoretical value. Accordingly, the difference between the total acid value and the JIS acid value is almost 50% for an acid anhydride. Thus, the acid value attributable to an acid anhydride group per g of a resin can be obtained by doubling the difference between the total acid value and the JIS acid value of the resin.

The method of the JIS acid value measurement is explained hereinbelow.

2-10 g of a sample resin is weighed and placed in a 200 to 300 ml-Erlenmeyer flask, and an ethanol/benzene (=½) mixture is added thereto to dissolve the resin. If the resin is not readily dissolved, a small amount of acetone may be added. The resultant solution is titrated with a preliminarily standardized N/10 KOH/alcohol solution with phenolphthalein as the indicator. The acid value is calculated from the consumption of the KOH-/alcohol solution based on the following equation:

$$\text{Acid value} = \text{vol (ml) of KOH/alcohol} \times N \times 56.1/\text{sample weight},$$

wherein N denotes the factor of the N/10 KOH/alcohol solution.

The total acid value of a binder resin used herein is measured in the following manner. A sample resin in an amount of 2 g is dissolved in 30 ml of dioxane, and 10 ml of pyridine, 20 mg of dimethylaminopyridine and 3.5 ml of water are added thereto, followed by 4 hours of heat refluxing. After cooling, the resultant solution is titrated with 1/10 N-KOH solution in THF (tetrahydrofuran) to neutrality with phenolphthalein as the indicator to measure the acid value, which is a total acid value (B).

The above-mentioned 1/10 N-KOH solution in THF is prepared as follows. First, 1.5 g of KOH is dissolved in about 3 ml of water, and 200 ml of THF and 30 ml of water are added thereto, followed by stirring. After standing, a uniform clear solution is formed, if necessary, by adding a small amount of methanol if the solution is separated or by adding a small amount of water if the solution is turbid. Then, the factor of the 1/10 N-KOH/THF solution thus obtained is standardized by a 1/10 N-HCl standard solution.

The binder resin used in the present invention may for example be prepared in following manner.

A polymer or copolymer (A-1) having a main peak in a molecular weight region of $2000-2\times10^4$ is prepared through solution polymerization, bulk polymerization, suspension polymerization, emulsion polymerization, block copolymerization or graft polymerization.

Then, the polymer or copolymer (A-1) is dissolved in a polymerizable monomer mixture containing 0.5–20 wt. %, preferably 1–15 wt. %, of a carboxyl group-containing vinyl monomer, followed by suspension polymerization to prepare a polymer or copolymer composition (B-1) which shows a main peak in a molecular weight region of $5000-10^5$ on a GPC chromatogram but can contain a gel content (THF-insoluble).

The composition (B-1) is melt-kneaded together with a metal-containing compound reactive with the carboxyl group in the polymer or copolymer under the action of a shearing force so as to sever a highly cross-linked polymer portion in the resin and cause a reaction with the metal-containing compound for re-crosslinking to provide a molecular weight distribution characteristic to the present invention. This process may be performed simultaneously at the time of toner production and thus the melt-kneading can be performed in the presence of a magnetic material or colorant. It is possible to effectively cause the re-crosslinking under the action of a heat evolved due to the severance of the polymer network.

As an alternative method for preparing a binder resin according to the present invention, it is possible to prepare a polymer or copolymer (B-2) capable of containing a gel content having a main peak in the molecular weight region of $5000-10^5$ on a GPC chromatogram by suspension polymerization of a polymerizable monomer mixture containing 0.5–20 wt. %, preferably 1–15 wt. %, of a carboxylic group-containing vinyl monomer, and a polymer or copolymer (A-2) having a main peak in the molecular weight region of $2000-10^5$ by solution polymerization, bulk polymerization, suspension polymerization, block copolymerization or graft polymerization, and blending the polymer or copolymer (B-2) and the polymer or copolymer (A-2) by melt-kneading.

It is also possible to blend a polymer or copolymer (B-3) having a carboxyl group or a carboxyl derivative group and comprising a principal component in the molecular weight region of at least $10^5$ obtained by solution polymerization, bulk polymerization, suspension polymerization, emulsion polymerization, etc., with the polymer or copolymer (A-1) or the polymer or copolymer (A-2) in a solvent after solution polymerization, and melt-knead the blend.

It is also possible to melt-knead a blend of the polymer or copolymer (B-3) with the polymer or copolymer (A-1) or the polymer or copolymer (A-2).

If the respective polymers or copolymers in the above-mentioned resins have main peaks in the range of $5000-5\times10^4$, it is also a preferred mode that the polymers or copolymers are prepared so as to have peaks overlapping each other.

Incidentally, within an extent not adversely affecting the present invention, the polymer(s) or copolymer(s) thus prepared can be mixed with another resin such as vinyl resin, polyester, polyurethane, epoxy resin, polyamide, polyvinyl butyral, rosin, modified rosin, terpene resin, phenolic resin, aliphatic or alicyclic hydrocarbon resin, aromatic petroleum resin, haloparaffin or paraffin wax.

It is also preferred to have the polymer or copolymer (A-1) and/or the polymer or copolymer (A-2) contain a carboxyl group or a derivative group thereof.

The polymer or copolymer(s) used in the present invention may assume a block copolymer or a graft copolymer.

In the bulk polymerization, it is possible to obtain a low-molecular weight polymer by performing the polymerization at a high temperature so as to accelerate the termination reaction, but there is a difficulty that the reaction control is difficult. In the solution polymerization, it is possible to obtain a low-molecular weight polymer or copolymer under moderate conditions by utilizing a radical chain transfer function depending on a solvent used or by selecting the polymerization initiator or the reaction temperature. Accordingly, the solution polymerization is preferred for preparation of a low-molecular weight polymer or copolymer used in the binder resin of the present invention.

The solvent used in the solution polymerization may for example include xylene, toluene, cumene, cellosolve acetate, isopropyl alcohol, and benzene. It is preferred to use xylene, toluene or cumene for a styrene monomer mixture. The solvent may be appropriately selected depending on the polymer produced by the polymerization. The polymerization initiator may for example include: di-tert-butyl peroxide, tert-butyl peroxybenzoate, benzoyl peroxide and 2,2'-azobis(2,4-dimethylvaleronitrile), one or more species of which may be used in a proportion of at least 0.05 wt. %, preferably 0.1–15 wt. parts, per 100 wt. parts of the vinyl monomer(s). The reaction temperature may depend on the solvent and initiator used and the polymer or copolymer to be produced but may suitably be in the range of 70°–230° C. In the solution polymerization, it is preferred to use 30–400 wt. parts of a vinyl monomer (mixture) per 100 wt. parts of the solvent. It is also preferred to mix one or more other polymers in the solution after completion of the polymerization.

In order to produce a highly-crosslinked high-molecular weight polymer component, the emulsion polymerization or suspension polymerization may preferably be adopted.

Of these, in the emulsion polymerization method, a vinyl monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitutes a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer. The suspension polymerization is more convenient in this respect.

On the other hand, in the suspension polymerization method, it is possible to obtain a product resin composition in a uniform state of pearls containing a medium- or high-molecular weight component uniformly mixed with a low-molecular weight component and a cross-linked component by polymerizing a vinyl monomer (mixture) containing a low-molecular weight polymer together with a crosslinking agent in a suspension state.

The suspension polymerization may preferably be performed by using at most 100 wt. parts, preferably 10–90 wt. parts, of a vinyl monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium while the amount is affected by the amount of the monomer relative to the aqueous medium. The polymerization temperature may suitably be in the range of 50°–95° C. and selected depending on the polymerization initiator used and the objective polymer. The polymerization initiator should be insoluble or hardly soluble in water, may for example include benzoyl peroxide and tert-butyl peroxyhexanoate and may be used in an amount of 0.5–10 wt. parts per 100 wt. parts of the vinyl monomer (mixture).

Examples of the vinyl monomer to be used for providing the binder resin of the present invention may include: styrene; styrene derivatives, such as o-methylstyrene, m-methylstyrene, p-methylstyrene, p-methoxystyrene, p-phenylstyrene, p-chlorostyrene, 3, 4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacrylonitrile, and acrylamide; the esters of the above-mentioned $\alpha,\beta$-unsaturated acids and the diesters of the above-mentioned dibasic acids. These vinyl monomers may be used singly or in combination of two or more species.

Among these, a combination of monomers providing styrene-type copolymers and styrene-acrylic type copolymers may be particularly preferred.

Examples of the carboxyl group-containing vinyl monomer or carboxyl derivative group-containing vinyl monomer may include: unsaturated dibasic acids, such as maleic acid, citraconic acid, itaconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; half esters of unsaturated dibasic acids, such as monomethyl maleate, monoethyl maleate, monobutyl maleate, monomethyl citraconate, monoethyl citraconate, monobutyl citraconate, monomethyl itaconate, monomethyl alkenylsuccinate, monomethyl fumarate, and monomethyl mesaconate; and unsaturated dibasic acid esters, such as dimethyl maleate and dimethyl fumarate. Further, there may also be used: $\alpha,\beta$-unsaturated acids, such as acrylic acid, methacrylic acid, crotonic acid, and cinnamic acid; $\alpha,\beta$-unsaturated acid anhydrides, such as crotonic anhydride and cinnamic anhydride; anhydrides between such $\alpha,\beta$-unsaturated acids and lower fatty acids; alkenylmalonic acid, alkenylglutaric acid, alkenyladipic acid, and anhydrides and monoesters of these acids.

Among the above, it is particularly preferred to use monoesters of $\alpha,\beta$-unsaturated dibasic acids, such as maleic acid, fumaric acid and succinic acid as a monomer for providing the binder resin used in the present invention.

The crosslinking monomer may principally be a monomer having two or more polymerizable double bonds.

The binder resin used in the present invention may preferably include a crosslinking structure obtained by using a crosslinking monomer, examples of which are enumerated hereinbelow.

Aromatic divinyl compounds, such as divinylbenzene and divinylnaphthalene; diacrylate compounds connected with an alkyl chain, such as ethylene glycol diacrylate, 1, 3-butylene glycol diacrylate, 1, 4-butanediol diacrylate, 1, 5-pentanediol diacrylate, 1, 6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl)propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylethane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of about 0.01–5 wt. parts, particularly about 0.03–3 wt. parts, per 100 wt. parts of the other vinyl monomer components.

Among the above-mentioned crosslinking monomers, aromatic divinyl compounds (particularly, divinylbenzene) and diacrylate compounds connected with a chain including an aromatic group and an ether bond may suitably be used in a toner resin in view of fixing characteristic and anti-offset characteristic.

The metal-containing compound reactive with the resin component in the present invention may be those containing metal ions as follows: divalent metal ions, such as $Ba^{2+}$, $Mg^{2+}$, $Ca^{2+}$, $Hg^{2+}$, $Sn^{2+}$, $Pb^{2+}$, $Fe^{2+}$, $Co^{2+}$, $Ni^{2+}$and $Zn^{2+}$; and trivalent ions, such as $Al^{3+}$, $Sc^{3+}$, $Fe^{3+}$, $Ce^{3+}$, $Ni^{3+}$, $Cr^{3+}$and $Y^{3+}$.

Among the above metal compounds, organic metal compounds provide excellent results because they are rich in compatibility with or dispersibility in a polymer and cause a crosslinking reaction uniformly in the polymer or copolymer.

Among the organic metal compounds, those containing an organic compound, which is rich in vaporizability or sublimability, as a ligand or a counter ion, are advantageously used. Among the organic compounds forming coordinate bonds or ion pairs with metal ions, examples of those having the above property may include: salicylic acid; salicylic acid derivatives, such as salicylamide, salicylamine, salicylaldehyde, salicylosalicylic acid, and di-tertbutylsalicylic acid; β-diketones, such as acetylacetone and propionylacetone; and low-molecular weight carboxylic acid salts, such as acetate and propionate.

In case where the organic metal complex is a metal complex, it can also function as a charge control agent for toner particles. Examples of such a metal complex include azo metal complexes represented by the following formula [I]:

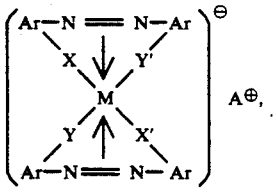

[I]

wherein M denotes a coordination center metal, inclusive of metal elements having a coordination number of 6, such as Sc, Ti, V, Cr, Co, Ni/Mn and Fe; Ar denotes an aryl group, such as phenyl or naphthyl, capable of having a substituent, examples of which may include: nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms; and A⊕ denotes hydrogen, sodium, potassium, ammonium or aliphatic ammonium.

Specific examples of this type of complex may include the following:

Complex [I]-1

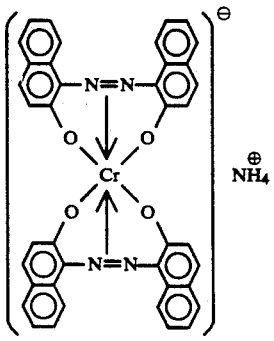

Complex [I]-2

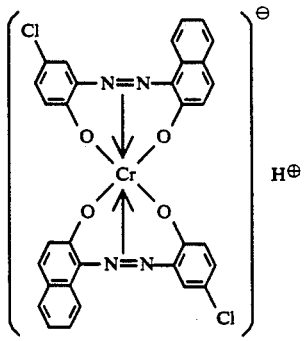

Complex [I]-3

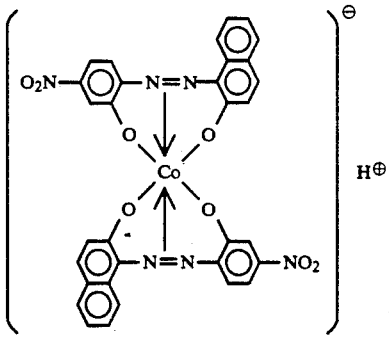

Complex [I]-4

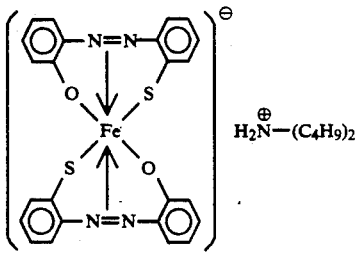

-continued

Complex [I]-5

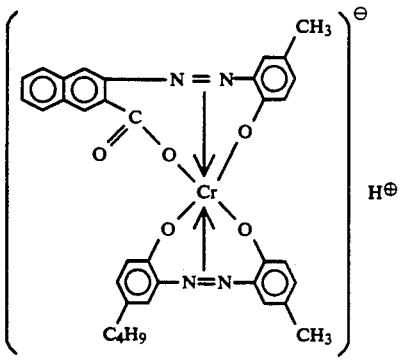

Complex [I]-6

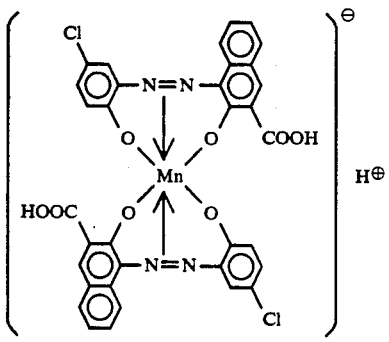

Organic metal complexes represented by the following formula [II]impart a negative chargeability and may be used as the organic metal compound in the present invention.

[II]

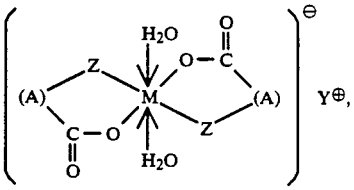

wherein M denotes a coordination center metal, inclusive of metal elements having a coordination number of 6, such as Cr, Co, Ni/Mn and Fe; A denotes

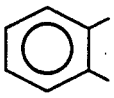

(capable of having a substituent, such as an alkyl

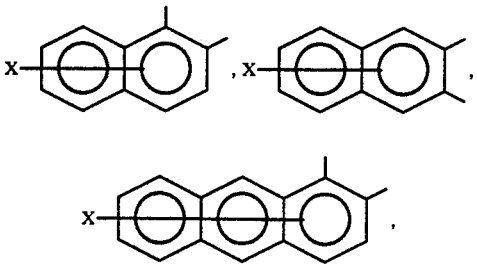

-continued

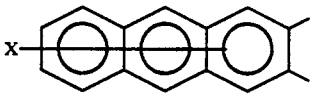

(X denotes hydrogen/, halogen, or nitro),

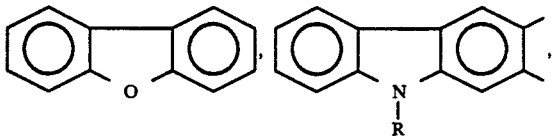

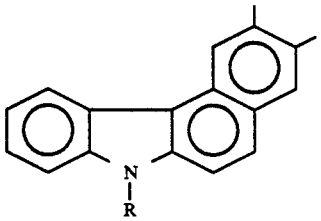

(R denotes hydrogen, $C_1$–$C_{18}$ alkyl or $C_1$–$C_{18}$ alkenyl); Y⊕ denotes a counter ion, such as hydrogen, sodium, potassium, ammonium, or aliphatic ammonium; and Z denotes —O— or —CO.O—.

The above organic metal compounds may be used singly or in combination of two or more species.

The addition amount of the organic metal compounds to the toner particles may be varied depending on the specific binder resin used, the use or nonuse of a carrier, the colorant for the toner and the reactivity of the metal compounds with the resin but may generally be 0.1–10 wt. %, preferably 0.1–1 wt. %, of the binder resin including the non-reacted portion thereof.

As a low fixing roller pressure is used in a small size copying machine or printer, excessive recrosslinking results in inferior fixability. Accordingly, the amount of the reactive metal compound may preferably be below 1 wt. % of the binder resin.

The above-mentioned organic metal complex or organic metal salt shows excellent compatibility and dispersibility to provide a toner with a stable chargeability, particularly when it is reacted with the binder resin at the time of melt-kneading.

As described above, the organic metal complex or organic metal salt as a crosslinking component can be also used as a charge control agent, but it is also possible to use another charge control agent, as desired, in combination. Such another charge control agent may for example be a known negative or positive charge control agent.

Examples of such known negative charge control agent may include: organic metal complexes and chelate compounds inclusive of monoazo metal complexes as described above, acetylacetone metal complexes, and organometal complexes of aromatic hydroxycarboxylic acids and aromatic dicarboxylic acids. Other examples may include: aromatic hydroxycarboxylic acids, aromatic mono- and poly-carboxylic acids, and their metal salts, anhydrides and esters, and phenol derivatives, such as bisphenols. Among the above, monoazo metal complexes are preferred.

Examples of the positive charge control agents may include: nigrosine and modified products thereof with aliphatic acid metal salts, etc., onium salts inclusive of quarternary ammonium salts, such as tributylbenzylammonium 1-hydroxy-4-naphtholsulfonate and tetrabutylammonium tetrafluoroborate, and their homologo inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; and diorganotin borates, such as dibutyltin borate, dioctyltin borate and dicyclohexyltin borate. These may be used singly or in mixture of two or more species. Among these, nigrosine compounds and tetraammonium salts are particularly preferred.

It is preferred to use the toner according to the present invention together with silica fine powder blended therewith in order to improve the charge stability, developing characteristic and fluidity.

The silica fine powder used in the present invention provides good results if it has a specific surface area of 30 $m^2/g$ or larger, preferably 50–400 $m^2/g$, as measured by nitrogen adsorption according to the BET method. The silica fine powder may be added in a proportion of 0.01–8 wt. parts, preferably 0.1–5 wt. parts, per 100 wt. parts of the toner.

For the purpose of being provided with hydrophobicity and/or controlled chargeability, the silica fine powder may well have been treated with a treating agent, such as silicone varnish, modified silicone varnish, silicone oil, modified silicone oil, silane coupling agent, silane coupling agent having functional group or other organic silicon compounds. It is also preferred to use two or more treating agents in combination.

Other additives may be added as desired, inclusive of: a lubricant, such as polytetrafluoroethylene, zinc stearate or polyvinylidene fluoride, of which polyvinylidene fluoride is preferred; an abrasive, such as cerium oxide, silicon carbide or strontium titanate, of which strontium titanate is preferred; a flowability-imparting agent, such as titanium oxide or aluminum oxide, of which a hydrophobic one is preferred; an anti-caking agent, and an electroconductivity-imparting agent, such as carbon black, zinc oxide, antimony oxide, or tin oxide. It is also possible to use a small amount of white or black fine particles having a polarity opposite to that of the toner as a development characteristic improver.

It is also preferred to add 0.5–5 wt. % of a waxy substance, such as low-molecular weight polyethylene, low-molecular weight polypropylene, lowmolecular weight propylene-ethylene copolymer, microcrystalline wax, carnauba wax, sasol wax or paraffin wax, to the toner for the purpose of improving the releasability of the toner at the time of hot roller fixation.

The toner according to the present invention can be mixed with carrier powder to be used as a two-component developer. In this instance, the toner and the carrier powder may be mixed with each other so as to provide a toner concentration of 0.1–50 wt. %, preferably 0.5–10 wt. %, further preferably 3–5 wt. %.

The carrier used for this purpose may be a known one, examples of which may include: powder having magnetism, such as iron powder, ferrite powder, and nickel powder and carriers obtained by coating these powders with a resin, such as a fluorine-containing resin, a vinyl resin or a silicone resin.

The toner according to the present invention can be constituted as a magnetic toner containing a magnetic material in its particles. In this case, the magnetic material can also function as a colorant. Examples of the magnetic material may include: iron oxide, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium; and mixtures of these materials.

The magnetic material may have an average particle size of 0.1–2 micron, preferably 0.1–0.5 micron.

The magnetic material may preferably show magnetic properties under application of 10 kiloOersted, inclusive of: a coercive force of 20–30 Oersted, a saturation magnetization of 50–200 emu/g, and a residual magnetization of 2–20 emu/g. The magnetic material may be contained in the toner in a proportion of 20–200 wt. parts, preferably 40–150 wt. parts, per 100 wt. parts of the resin component.

The toner according to the present invention can contain a colorant which may be an appropriate pigment or dye.

Examples of the pigment may include: carbon black, aniline black, acetylene black, Naphthol Yellow, Hansa Yellow, Rhodamine Lake, Alizarin Lake, red iron oxide, Phthalocyanine Blue, and Indanthrene Blue. These pigments are used in an amount sufficient to provide a required optical density of the fixed images, and may be added in a proportion of 0.1–20 wt. parts, preferably 2–10 wt. parts, per 100 wt. parts of the binder resin.

Examples of the dye may include: azo dyes, anthraquinone dyes, xanthene dyes, and methine dyes, which may be added in a proportion of 0.1–20 wt. parts, preferably 0.3–10 wt. parts, per 100 wt. parts of the binder resin.

The toner according to the present invention may be prepared through a process including: sufficiently blending the binder resin, the organic metal compound such as the metal salt or metal complex, a colorant, such as pigment, dye and/or a magnetic material, and an optional charge control agent and other additives, as desired, by means of a blender such as a Henschel mixer or a ball mill, melting and kneading the blend by means of hot kneading means, such as hot rollers, a kneader or an extruder to cause melting of the resinous materials and disperse or dissolve the magnetic material, pigment or dye therein, and cooling and solidifying the kneaded product, followed by pulverization and classification.

The thus obtained toner may be further blended with other external additives, as desired, sufficiently by means of a mixer such as a Henschel mixer to provide a developer for developing electrostatic images In the above-mentioned melt-kneading step for production of a toner, it is possible to also effect the severance of the highly crosslinked high-molecular weight resin component. The severance may be effectively accomplished by performing the melt-kneading in a low-temperature melting state so as to exert a high shearing force, and the re-crosslinking of the resin composition is effected with the metal-containing compound under heating during the melt-kneading.

If an extruder is used for example and an axial or screw arrangement suitable for applying a shear force is adopted and operated at a relatively low set temperature, a high shearing force is applied to the mixture when the mixture passes through the kneading section to sever the polymer network and then cause the recrosslinking by reaction of the resin with the metal-containing compound while the mixture is discharged and cooled.

A GPC chromatogram (chart) of a resin composition A used in Example 1 appearing hereinafter is reproduced herein as FIG. 1. The resin composition contains a THF-insoluble content which is removed by a filter when a GPC sample solution is prepared and thus cannot be observed by GPC. A GPC chromatogram of a resin composition obtained by kneading the resin composition A by a kneader used in Example 1 is reproduced as FIG. 2. The resin composition does not contain a THF-insoluble resin component and the severed high-molecular weight component appears as a peak on the chromatogram. Further, a GPC chromatogram of a composition obtained by kneading the resin composition A with a metal-containing compound is reproduced as FIG. 3, wherein a component formed by recrosslinking is extended to a higher molecular weight side. Accordingly, the above-mentioned change in molecular weight distribution during melt-kneading may be confirmed through comparison of FIGS. 1–3.

Hereinbelow, the present invention will be described in more detail based on Examples. First of all, Synthesis Examples of binder resins for use in toners are explained, in which the glass transition temperatures (Tg) of the resins were measured by using a differential scanning calorimeter (DSC) ("DSC-7", available from Perkin-Elmer Co.) in the following manner.

A sample resin in an amount of 5–20 mg, preferably about 10 mg, is accurately weighed and placed in an aluminum pan (an empty pan being used as a reference). The measurement is performed in a normal temperature—normal humidity environment at a temperature raising rate of 10° C./min within a temperature range of 30° C. to 200° C. A heat absorption main peak is generally found in the range of 40°–100° C.

Based on the heat absorption curve, a first base line is drawn before an initial slope leading to the main peak and a second base line is drawn after a final slope descending from the main peak. A medium line is drawn substantially in parallel with and with equal distances from the first and second base lines, whereby the medium line and the heat absorption curve form an intersection with each other. The temperature at the intersection is taken as the glass transition temperature (Tg°C.).

The values of Tg thus measured, various acid values and main peak positions on GPC chromatograms for the binder resins obtained in Synthesis Examples are summarized in Table 1 appearing after Synthesis Examples.

SYNTHESIS EXAMPLE 1

| | |
|---|---|
| Styrene | 70.0 wt. parts |
| n-Butyl acrylate | 25.0 wt. parts |
| Acrylic acid | 5.0 wt. parts |
| Di-tert-butyl peroxide | 1.5 wt. parts |

A monomer mixture having the above composition was added dropwise in 4 hours to 200 wt. parts of toluene under heating, and the polymerization was completed under toluene refluxing, followed by removal of toluene under a reduced pressure and heating (at 120° C.), to obtain a styrene copolymer resin.

| | |
|---|---|
| The above resin | 30.0 wt. part(s) |
| Styrene | 44.65 wt. part(s) |
| n-Butyl acrylate | 20.0 wt. part(s) |
| Mono-n-butyl maleate | 5.0 wt. part(s) |
| Divinylbenzene | 5.0 wt. part(s) |
| Benzoyl peroxide | 0.35 wt. part(s) |
| Di-tert-butyl peroxy-2-ethyl hexanoate | 0.70 wt. part(s) |

Into a mixture liquid having the above composition, 170 wt. parts of water containing 0.12 wt. part of partially saponified polyvinyl alcohol was added, and the mixture was vigorously stirred to form a suspension liquid. Into a reaction vessel containing 50 wt. parts of water and purged with nitrogen, the above suspension liquid was added and subjected to 8 hours of suspension polymerization at 80° C. After the completion of the reaction, the product was washed with water, dewatered and dried to obtain a resin composition A containing a styrene copolymer crosslinked with divinylbenzene.

SYNTHESIS EXAMPLE 2

| | |
|---|---|
| Styrene | 70.0 wt. part(s) |
| n-Butyl acrylate | 30.0 wt. part(s) |
| Di-tert-butyl peroxide | 2.0 wt. part(s) |

Solution polymerization was performed by using the above monomer mixture otherwise in the same manner as in Synthesis Example 1 to obtain a resin.

| | |
|---|---|
| The above resin | 30.0 wt. part(s) |
| Styrene | 44.70 wt. part(s) |
| n-Butyl acrylate | 20.0 wt. part(s) |
| Mono-n-butyl maleate | 3.0 wt. part(s) |
| Divinylbenzene | 0.40 wt. part(s) |
| Benzoyl peroxide | 1.30 wt. part(s) |
| Di-tert-butyl peroxy-2-ethylhexanoate | 0.80 wt. part(s) |

Suspension polymerization was performed by using the above mixture otherwise the same manner as in Synthesis Example 1 to obtain a resin composition B.

SYNTHESIS EXAMPLE 3

| | |
|---|---|
| Styrene | 75.0 wt. part(s) |
| n-Butyl acrylate | 20.0 wt. part(s) |
| Methacrylic acid | 5.0 wt. part(s) |
| Di-tert-butyl peroxide | 2.0 wt. part(s) |

Solution polymerization was performed by using the above monomer mixture otherwise in the same manner as in Synthesis Example 1 to obtain a resin.

| | |
|---|---|
| The above resin | 30.0 wt. part(s) |
| Styrene | 44.65 wt. part(s) |
| n-Butyl acrylate | 20.0 wt. part(s) |
| Acrylic acid | 5.0 wt. part(s) |
| Divinylbenzene | 0.35 wt. part(s) |
| Benzoyl peroxide | 1.00 wt. part(s) |
| Di-tert-butyl peroxy-2-ethylhexanoate | 0.70 wt. part(s) |

suspension polymerization was performed by using the above mixture otherwise the same manner as in Synthesis Example 1 to obtain a resin composition C.

SYNTHESIS EXAMPLE 4

| | |
|---|---|
| Styrene | 78.0 wt. parts |
| n-Butyl acrylate | 18.0 wt. parts |
| Mono-n-butyl maleate | 5.0 wt. parts |
| Divinylbenzene | 0.5 wt. parts |
| Di-tert-butyl peroxy-2-ethylhexanoate | 0.8 wt. parts |

A monomer mixture having the above composition was added dropwise in 4 hours to 200 wt. parts of toluene under heating, and the polymerization was completed under toluene refluxing, followed by removal of toluene under reduced pressure and heating (at 120° C.), to obtain a resin D.

SYNTHESIS EXAMPLE 5

| | |
|---|---|
| Styrene | 75.0 wt. parts |
| n-Butyl acrylate | 20.0 wt. parts |
| Mono-n-butyl malate | 5.0 wt. parts |
| Di-tert-butyl peroxide | 0.7 wt. parts |

A monomer mixture having the above composition was added dropwise in 4 hours to 200 wt. parts of toluene under heating, and the polymerization was completed under toluene refluxing to form a styrene copolymer. Then, into the reaction required, the resin D having a higher molecular weight was added so as to provide a ratio of the resin D/the styrene copolymer=4/6 and the mixture was sufficiently stirred and subjected to removal of toluene under reduced pressure and heating (at 120° C.), to obtain a resin composition E.

SYNTHESIS EXAMPLE 6

| | |
|---|---|
| Styrene | 75.0 wt. part(s) |
| n-Butyl acrylate | 20.0 wt. part(s) |
| Mono-n-butyl maleate | 5.0 wt. part(s) |
| Divinylbenzene | 0.05 wt. part(s) |
| Azobisvaleronitrile | 0.70 wt. part(s) |

Suspension polymerization was performed by using the above monomer mixture otherwise in the same manner as in Synthesis Example 1 to obtain a resin F.

SYNTHESIS EXAMPLE 7

| | |
|---|---|
| Styrene | 72.0 wt. parts |
| n-Butyl acrylate | 25.0 wt. parts |
| Mono-n-butyl malate | 3.0 wt. parts |
| Di-tert-butyl peroxide | 1.0 wt. parts |

A monomer mixture having the above composition was added dropwise in 4 hours to 200 wt. parts of toluene under heating, and the polymerization was completed under toluene refluxing to for a styrene copolymer. Then, into the reaction required, the resin F having a higher molecular weight was added so as to provide a ratio of the resin F/the styrene copolymer=3/7 and the mixture was sufficiently stirred and subjected to removal of toluene under reduced pressure and heating (at 120° C.), to obtain a resin composition G.

SYNTHESIS EXAMPLE 8

| | |
|---|---|
| Styrene | 90.0 wt. part(s) |
| n-Butyl acrylate | 10.0 wt. part(s) |
| Di-tert-butyl peroxide | 7.0 wt. part(s) |

Solution polymerization was performed by using the above monomer mixture otherwise in the same manner as in Synthesis Example 1 to obtain a resin.

| | |
|---|---|
| The above resin | 70.0 wt. part(s) |
| Styrene | 44.65 wt. part(s) |
| n-Butyl acrylate | 20.0 wt. part(s) |
| Mono-n-butyl maleate | 5.0 wt. part(s) |
| Divinylbenzene | 0.35 wt. part(s) |
| Benzoyl peroxide | 1.00 wt. part(s) |
| Di-tert-butyl peroxy-2-ethylhexanoate | 0.70 wt. part(s) |

Suspension polymerization was performed by using the above mixture otherwise the same manner as in Synthesis Example 1 to obtain a resin composition H.

SYNTHESIS EXAMPLE 9

| | |
|---|---|
| Styrene | 68.0 wt. parts |
| n-Butyl acrylate | 22.7 wt. parts |
| Mono-n-butyl maleate | 8.0 wt. parts |
| Divinylbenzene | 1.3 wt. parts |
| Di-tert-butyl peroxyhexanoate | 0.6 wt. parts |

A monomer mixture having the above composition was added dropwise in 4 hours to 200 wt. parts of cumene under heating, and the polymerization was completed under toluene refluxing, followed by removal of cumene under reduced pressure and heating (at 200° C.), to obtain a styrene copolymer resin I.

The properties of the resins or resin compositions obtained in the above-described Synthesis Examples are summarized in the following Table 1.

TABLE 1

| Properties of resin or resin compositions | | | | | |
|---|---|---|---|---|---|
| | Acid value (mgKOH/g) | | | GPC peak molecular | Tg |
| Resin | JIS | Total | Anhydride | weight(s) | (°C.) |
| A | 28.0 | 28.0 | 0.0 | 17,000 | 57.2 |
| B | 9.8 | 9.8 | 0.0 | 24,000 | 57.5 |
| C | 48.7 | 48.6 | 0.0 | 8,200<br>31,000 | 57.8 |
| D | 16.5 | 17.4 | 1.8 | 290,000 | 57.9 |
| E | 16.4 | 18.1 | 3.4 | 18,000<br>300,000 | 56.9 |
| F | 16.4 | 16.4 | 0.0 | 720,000 | 57.7 |
| G | 11.7 | 12.4 | 1.4 | 12,000<br>690,000 | 58.1 |
| H | 16.3 | 16.2 | 0.0 | 4,900<br>42,000 | 57.6 |
| I | 26.1 | 35.9 | 19.6 | 21,000 | 58.0 |

EXAMPLE 1

| | |
|---|---|
| Resin Composition A | 100 wt. part(s) |
| Magnetic iron oxide | 80 wt. part(s) |
| Di-tert-butylsalicylic acid Cr complex | 2 wt. part(s) |
| Low-molecular weight ethylene-propylene copolymer | 3 wt. part(s) |

The above ingredients were preliminarily blended and melt-kneaded through a twin-screw extruder having a kneading zone incorporating a backward screw. The kneaded product was cooled, coarsely crushed, finely pulverized by means of a pulverizer using jet air stream, and classified by a wind-force classifier to obtain a magnetic toner having a weight-average particle size of 8 microns. The cooled kneaded product showed a good pulverizability without over-pulverization and with little occurrence of fine powder. Further, no melt-sticking of pulverized product was observed in the pulverizer. Data for evaluating the pulverizability are summarized in Table 2 appearing hereinafter. The pulverizability of the kneaded product was evaluated by a pulverizer using a jet air stream of 2 $m^3$/min and a pressure of 5 kg/$cm^2$ in terms of the processing capacity per unit time. The fine powder amount was measured by using a Coulter counter (Model TA-II, available from Coulter Electronics, Co.) and a 100 micron-aperture after dispersion in 1% NaCl aqueous solution in the presence of a surfactant.

The above-prepared magnetic toner was subjected to preparation of a GPC sample having a resin concentration of 5 mg/ml, and no binder resin component was found to remain on the filter at that time. The GPC sample was subjected to measurement of molecular weight distribution by GPC using a high-speed liquid chromatograph ("150C", available from Waters Co.) and a combination of columns ("Shodex GPC KF-801, 802, 803, 804, 805, 806, 807 and 800P", available from Showa Denko K.K.). The measured data regarding the molecular weight distribution of the toner binder resin are shown in Tables 3 and 4.

100 wt. parts of the above-prepared magnetic toner and 0.6 wt. part of hydrophobic colloidal silica were blended with each other to prepare a developer which was then evaluated using a commercially available high-speed electrophotographic copying machine at a rate of 82 A4 size sheets/min. ("NP-8580", mfd. by Canon K.K.) with respect to fixability, toner flowout preventing characteristic, image quality and durability. In addition to these results, the storability and the result of $5\times10^5$ sheets-copying test are shown in Tables 5 and 6. Throughout the copying test, images having a high density (1.35–1.40) and free from fog were stably obtained. The images were faithful to the original and showed excellent dot-reproducibility and thin line-reproducibility. The storability (anti-caking characteristic) was evaluated by planing about 1.5 kg of the toner in a 3 liter-plastic bottle, leaving the bottle standing for 1 day at 50° C. and then observing the dischargeability of the toner from the bottle. The fixability was evaluated after placing the test apparatus in an environment of low temperature—low humidity (15° C.-10%) overnight so as to fully adapt the test apparatus and the fixing device therein and then making continuously 200 sheets of copied images, of which the copied image on the 200th sheet was used for evaluation of the fixability by rubbing the image with a lens cleaning paper ("Dusper"(trade name), mfd. by OZU Paper Co., Ltd.) for 10 reciprocations under a weight of about 100 g. Then, the degree of peeling of the toner image was evaluated in terms of a decrease (%) in reflection density. The anti-offset characteristic was evaluated by taking continuously 200 sheets of copied images, then taking intermittently sheets of copied images for 3 minutes at intervals of 30 seconds per sheet, and then observing whether images were stained or not. Further, the degree of staining of the cleaning web incorporated in the fixing device was evaluated.

As a result, the toner showed a good storability in terms of dischargeability, a good fixability without causing offset and no re-flowout of the toner material from the cleaning web in the fixing device.

EXAMPLE 2

| | |
|---|---|
| Resin composition B | 100 wt. parts |
| Magnetic iron oxide | 80 wt. parts |
| Di-tert-butylsalicylic acid Cr complex | 2 wt. parts |
| Low-molecular weight ethylene-propylene copolymer | 3 wt. parts |

A magnetic toner having a weight-average particle size of 8 microns was prepared by using the above ingredients otherwise in the same manner as in Example 1. The pulverizability of the toner material is shown in Table 2, and the molecular weight distribution data are shown in Tables 3 and 4. A developer was prepared from the toner and evaluated in the same manner as in Example 1. The evaluation results are shown in Tables 5 and 6.

EXAMPLE 3

| | |
|---|---|
| Resin composition C | 100 wt. parts |
| Magnetic iron oxide | 80 wt. parts |
| Di-tert-butylsalicylic acid Cr complex | 2 wt. parts |
| Low-molecular weight ethylene-propylene copolymer | 3 wt. parts |

A magnetic toner having a weight-average particle size of 8 microns was prepared by using the above ingredients otherwise in the same manner as in Example 1. The pulverizability of the toner material is shown in Table 2, and the molecular weight distribution data are shown in Tables 3 and 4. A developer was prepared from the toner and evaluated in the same manner as in Example 1. The evaluation results are shown in Tables 5 and 6.

EXAMPLE 4

| | |
|---|---|
| Resin composition E | 100 wt. parts |
| Magnetic iron oxide | 80 wt. parts |
| Di-tert-butylsalicylic acid Cr complex | 2 wt. parts |
| Low-molecular weight ethylene-propylene copolymer | 3 wt. parts |

A magnetic toner having a weight-average particle size of 8 microns was prepared by using the above ingredients otherwise in the same manner as in Example 1. The pulverizability of the toner material is shown in Table 2, and the molecular weight distribution data are shown in Tables 3 and 4. A developer was prepared from the toner and evaluated in the same manner as in Example 1. The evaluation results are shown in Tables 5 and 6.

EXAMPLE 5

| | |
|---|---|
| Resin composition G | 100 wt. parts |
| Magnetic iron oxide | 80 wt. parts |
| Di-tert-butylsalicylic acid | 3 wt. parts |

-continued

| | |
|---|---|
| Cr complex | |
| Low-molecular weight ethylene-propylene copolymer | 3 wt. parts |

A magnetic toner having a weight-average particle size of 8 microns was prepared by using the above ingredients otherwise in the same manner as in Example 1. The pulverizability of the toner material is shown in Table 2, and the molecular weight distribution data are shown in Tables 3 and 4. A developer was prepared from the toner and evaluated in the same manner as in Example 1. The evaluation results are shown in Tables 5 and 6.

COMPARATIVE EXAMPLE 1

| | |
|---|---|
| Resin H | 100 wt. parts |
| Magnetic iron oxide | 80 wt. parts |
| Di-tert-butylsalicylic acid Cr complex | 2 wt. parts |
| Low-molecular weight ethylene-propylene copolymer | 3 wt. parts |

A magnetic toner having a weight-average particle size of 8 microns was prepared by using the above ingredients otherwise in the same manner as in Example 1. The pulverizability of the toner material is shown in Table 2, and the molecular weight distribution data are shown in Tables 3 and 4. A developer was prepared from the toner and evaluated in the same manner as in Example 1. The evaluation results are shown in Tables 5 and 6. The toner material caused slight over pulverization, showed a poor classification efficiency and resultant in a slight degree of sticking of the pulverization product in the pulverizer. Compared with the toner in Example 1, the toner showed somewhat inferior toner dischargeability and toner flowout preventing characteristic. In the durability test, increases in fog and melt-sticking were observed.

COMPARATIVE EXAMPLE 2

| | |
|---|---|
| Resin I | 100 wt. parts |
| Magnetic iron oxide | 80 wt. parts |
| Di-tert-butylsalicylic acid Cr complex | 2 wt. parts |
| Low-molecular weight ethylene-propylene copolymer | 3 wt. parts |

A magnetic toner having a weight-average particle size of 8 microns was prepared by using the above ingredients otherwise in the same manner as in Example 1. The pulverizability of the toner material is shown in Table 2, and the molecular weight distribution data are shown in Tables 3 and 4. A developer was prepared from the toner and evaluated in the same manner as in Example 1. The evaluation results are shown in Tables 5 and 6. Remarkable crosslinking was caused to provide much non-filtered matter, thus resulting in inferior fixability. Because of much acid anhydride excessive charge was encountered during the durability test to resulting a lower image density in some images.

COMPARATIVE EXAMPLE 3

| | |
|---|---|
| Resin A | 100 wt. parts |
| Magnetic iron oxide | 80 wt. parts |
| Low-molecular weight ethylene-propylene copolymer | 3 wt. parts |

A magnetic toner having a weight-average particle size of 8 microns was prepared by using the above ingredients otherwise in the same manner as in Example 1. The pulverizability of the toner material is shown in Table 2, and the molecular weight distribution data are shown in Tables 3 and 4. A developer was prepared from the toner and evaluated in the same manner as in Example 1. The evaluation results are shown in Tables 5 and 6. Because the component having a molecular weight of at least $5\times10^6$ was little and the molecular weight distribution showed a narrow distribution in the range of from the high-molecular weight region to the ultra-high-molecular weight region, the toner flowout-preventing characteristic was inferior.

TABLE 2

| | Pulverizability | | |
|---|---|---|---|
| | Pulverizability (kg/hr) | Proportion of particles of ≦4 microns (% by number) | Sticking in pulverizer |
| Example 1 | 4.4 | 41.6 | None |
| 2 | 4.1 | 40.8 | None |
| 3 | 4.5 | 42.3 | None |
| 4 | 4.0 | 43.1 | None |
| 5 | 4.2 | 43.5 | None |
| Comp. 1 | 4.3 | 51.8 | Observed |
| Example 2 | 5.4 | 40.7 | None |
| 3 | 4.2 | 41.2 | None |

TABLE 3

| | Properties of toner binder resin | | | | | | |
|---|---|---|---|---|---|---|---|
| | Molecular weight distribution | | | | | | |
| | Weight fraction (wt. %) | | | | Peak molecular weight | | JIS acid value |
| | ≦5,000 | 5,000–10,000 | 100,000–5,000,000 | ≧5,000,000 | Main peak | Sub peak | (mgKOH/g) |
| Example 1 | 6.7 | 54.1 | 23.3 | 15.9 | 21,000 | — | ca.28 |
| 2 | 4.8 | 58.8 | 22.1 | 14.3 | 25,000 | — | ca.9 |
| 3 | 11.7 | 59.9 | 20.0 | 8.4 | 29,000 | 84,000 | ca.48 |
| 4 | 6.4 | 59.7 | 21.4 | 12.5 | 22,000 | — | ca.16 |
| 5 | 8.1 | 53.6 | 21.1 | 17.2 | 12,000 | — | ca.11 |
| Comp. 1 | 18.1 | 53.0 | 17.4 | 11.5 | 5,100 | 39,000 | ca.16 |
| Example 2 | 10.3 | 61.1 | 18.8 | 9.8 | 22,000 | — | ca.26 |
| 3 | 8.5 | 53.5 | 33.6 | 4.4 | 18,000 | 2,530,000 | ca.28 |

TABLE 4

| | Average molecular weight of toner binder resin | | | | |
|---|---|---|---|---|---|
| | Mn × $10^4$ | Mw × $10^4$ | Mz × $10^4$ | Mw/Mn | Mz/Mw |
| Example 1 | 1.6 | 1,170 | 19,300 | 731 | 16.5 |
| 2 | 1.8 | 960 | 24,100 | 533 | 25.1 |
| 3 | 1.4 | 610 | 6,300 | 436 | 10.3 |
| 4 | 1.6 | 940 | 21,900 | 588 | 23.3 |

TABLE 4-continued

| | Average molecular weight of toner binder resin | | | | |
|---|---|---|---|---|---|
| | Mn × $10^4$ | Mw × $10^4$ | Mz × $10^4$ | Mw/Mn | Mz/Mw |
| 5 | 1.5 | 1,800 | 17,800 | 1,200 | 9.9 |
| Comp. 1 | 1.0 | 1,100 | 25,400 | 1,100 | 23.1 |
| Example 2 | 1.4 | 380 | 16,000 | 271 | 42.1 |
| 3 | 1.4 | 98 | 1,030 | 71 | 10.5 |

TABLE 5

| | Fixing performances | | | |
|---|---|---|---|---|
| | Storability | | Anti-offset characteristic | |
| | dischargeability | Fixability | Image stain Toner flowout | Web stain |
| Example 1 | ○ | 7% | ○ | ○ |
| 2 | ○ | 9% | ○ | ○ |
| 3 | ○ | 8% | ○ | ○ |
| 4 | ○ | 6% | ○ | ○ |
| 5 | ○ | 10% | ○ | ○ |
| Comp. 1 | Δ | 9% | Δ | Δ |
| Example 2 | ○ | 21% | ○ | ○ |
| 3 | ○ | 9% | x | Δ |

Evaluation standards
Storability, Dischargeability
○: Good. Dischargeable as it is.
Δ: Fair. Dischargeable after a little shaking.
x: Poor. Not dischargeable without sufficient shaking.
Anti-offset characteristic
Image stain: ○: Good. No stain
Δ: Fair. A little stain.
x: Poor. Conspicuous stain.
Web stain: ○: Good. Little stain.
Δ: Fair. Noticeable stain.
x: Poor. Stain and accumulated toner material.

TABLE 6

| | Durability (continuous copying performances) | | |
|---|---|---|---|
| | | Melting sticking, Filming | |
| | Image quality | Toner carrying member | Photosensitive member |
| Example 1 | ○ | ○ | ○ |
| 2 | ○ | ○ | ○ |
| 3 | ○ | ○ | ○ |
| 4 | ○ | ○ | ○ |
| 5 | ○ | ○ | ○ |
| Comp. 1 | Δ | Δ | Δ |
| Example 2 | Δ | ○ | ○ |
| 3 | ○ | ○ | ○ |

Evaluation standards:
Melt sticking, Filming: ○: Good, Δ: Fair, Practically acceptable.
Image quality: ○: Good, Δ: Described in the respective Comp. Examples.

As described above, the toner according to the present invention shows excellent performances as shown below because it contains a binder resin having a specific molecular weight distribution.

(1) Fixable at a low temperature and free from image stains due to toner flowout from a fixer cleaning member.

(2) Causing no melt-sticking or filming on a toner-carrying member or photosensitive member even in a high-speed copying or printing system.

(3) Showing excellent anti-blocking characteristic and good storability.

(4) Causing little over-pulverization or meltsticking regardless of good pulverization.

(5) Causing little fine powder at the time of pulverization and showing a good productivity.

(6) Causing little fine powder and excellent in developing performance and durability.

What is claimed is:

1. A toner for developing an electrostatic image, comprising: a binder resin and a colorant, wherein the binder resin shows a molecular weight distribution on a GPC chromatogram of its tetrahydrofuran (THF)-soluble resin content including below 15% of a resin component in a molecular weight region of at most 5,000 and at least 5% of a resin component in a molecular weight region of at least $5\times10^6$ and showing a main peak in a molecular weight region of 5,000 to $10^5$, wherein the binder resin has an acid value attributable to acid anhydride groups of at most 10 mgKOH/g and (ii) a weight average molecular weight of at least 5'$10^6$ as calculated based on the GPC chromatogram.

2. The toner according to claim 1, wherein said binder resin is a vinyl polymer, a vinyl copolymer or a mixture thereof.

3. The toner according to claim 1, wherein said binder resin comprises a vinyl copolymer composition.

4. The toner according to claim 1, wherein said binder resin comprises a mixture of a crosslinked vinyl copolymer and a non-crosslinked vinyl copolymer.

5. The toner according to claim 1, wherein said binder resin comprises a mixture of a crosslinked styrene copolymer and a non-crosslinked styrene copolymer.

6. The toner according to claim 1, wherein said binder resin contains a crosslinkage formed by a crosslinking agent having at least two vinyl groups, and an electrostatic crosslinkage formed by a carboxylic group and a metal ion of two or more valences.

7. The toner according to claim 1, wherein said binder resin shows a molecular weight distribution including 7–30% of a resin component in the molecular weight region of at least $5\times10^6$.

8. The toner according to claim 1, wherein said binder resin shows a molecular weight distribution including 8–25% of a resin component in the molecular weight region of at least $5\times10^6$.

9. The toner according to claim 1, wherein said binder resin shows a molecular weight distribution including 10–30% of a resin component in the molecular weight of $10^5$ to $5\times10^6$.

10. The toner according to claim 1, wherein said binder resin shows a molecular weight distribution including 2–14% of a resin component in the molecular weight region of at most 5000, 10–30% of a resin component in the molecular weight region of $10^5$ to $5\times10^6$, and 3–20% of a resin component in the molecular weight region of at least $5\times10^6$.

11. The toner according to claim 1, wherein said binder resin has a carboxyl group and contains an organic metal compound electrostatically linkable with the carboxylic group.

12. The toner according to claim 1, wherein said binder resin shows a molecular weight distribution showing a main peak in a molecular weight region of $10^4$ to $5\times10^4$.

13. The toner according to claim 1, wherein said binder resin shows a molecular weight distribution including at least 40% of a resin component in a molecular weight region of 5000 to $10^5$.

14. The toner according to claim 1, wherein said binder resin shows a molecular weight distribution including 2–14% of a resin component in the molecular weight region of at most 5000, at least 45% of a resin component in the molecular weight region of 5000 to $10^5$, and 7–30% of a resin component in the molecular weight region of at least $5\times10^6$.

15. The toner according to claim 1, wherein said binder resin has a JIS acid value of 2-100 kgKOH/g.

16. The toner according to claim 1, wherein said binder resin has a JIS acid value of 5-70 mgKOH/g.

17. The toner according to claim 1, wherein said binder resin has an acid value attributable to acid anhydride group of below 6 mgKOH/g.

18. The toner according to claim 1, wherein said binder resin contains a styrene-maleic acid half ester copolymer.

19. The toner according to claim 1, wherein said binder resin contains a styrene-maleic acid ester copolymer.

20. The toner according to claim 1, wherein said binder resin contains a styrene-maleic anhydride copolymer.

21. The toner according to claim 1, wherein said binder resin contains a non-crosslinked styrene-maleic acid half ester copolymer and a styrene-maleic acid half ester copolymer crosslinked with divinylbenzene.

22. The toner according to claim 1, wherein said colorant comprises a magnetic material.

23. The toner according to claim 1, wherein said colorant comprises carbon black.

24. The toner according to claim 1, wherein said binder resin has a carboxyl group or acid anhydride group and contains an organic metal compound reactive with the carboxyl group or acid anhydride group.

25. The toner according to claim 24, wherein said organic metal compound is an azo metal complex represented by the following formula:

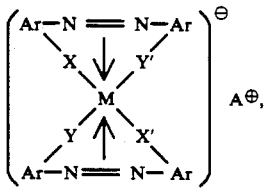

wherein M is a coordination center metal selected from the group consisting of Sc, Ti, V, Cr, Co, Ni and Fe; Ar is a substituted or unsubstituted aryl group; X, X', Y and Y' are independently a member selected from the group consisting of —O—, —CO—, —NH—, or —NR— Wherein R is an alkyl having 1-4 carbon atoms; and A⊕ is a cation selected from the group consisting of hydrogen ion, sodium ion, potassium ion, ammonium ion and aliphatic ammonium ion.

26. The toner according to claim 24, wherein said organic metal compound is an organic acid metal complex represented by the following formula:

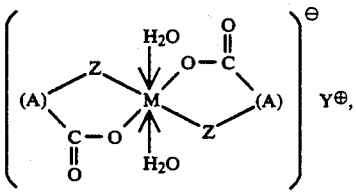

wherein M is a coordination center metal selected from the group consisting of Cr, Co, Ni and Fe; A is a substituted or unsubstituted aryl group; Y⊕ is a cation selected from the group consisting of hydrogen ion, sodium ion, potassium ion, ammonium ion and aliphatic ammonium ion, and Z is a member selected from the group consisting —O— or —CO.O—.

27. The toner according to claim 1, wherein a waxy substance is further contained.

28. The toner according to claim 1, wherein said binder resin shows a molecular weight distribution on the GPC chromatogram showing a maximum in the molecular weight region of at least $5\times10^6$.

29. The toner according to claim 1, wherein the THF-soluble resin content of the binder resin shows a weight-average molecular weight (Mw) of $6\times10^6$-$2\times10^7$.

30. The toner according to claim 1, wherein the THF-soluble resin content of the binder resin shows a number-average molecular weight (Mn) of at most $4\times10^4$.

31. The toner according to claim 1, wherein the THF-soluble resin content of the binder resin shows an Mn of at most $3\times10^4$.

32. The toner according to claim 1, wherein the THF-soluble resin content of the binder resin shows an Mn of at most $2.5\times10^4$.

33. The toner according to claim 1, wherein the THF-soluble resin content of the binder resin shows an Mw/Mn ratio of at least 125.

34. The toner according to claim 1, wherein the THF-soluble resin content of the binder resin shows an Mw/Mn ratio of at least 170.

35. The toner according to claim 1, wherein the THF-soluble resin content of the binder resin shows a Z-average molecular weight (Mz) of at least $2\times10^7$.

36. The toner according to claim 1, wherein the THF-soluble resin content of the binder resin shows an Mz/Mw ratio of at most 40.

37. The toner according to claim 1, wherein the THF-soluble resin content of the binder resin shows an Mz/Mw ratio of 5-30.

38. The toner according to claim 1, wherein the binder resin contains a THF-insoluble resin component in a proportion of at most 10 wt. % measured as a residue on a filter having a pore size of 0.45-0.5 micron when the binder resin is mixed with THF to provide a concentration of 5 mg/ml and the mixture is left standing for about 30 hours at room temperature and then subjected to filtration by using the filter.

39. The toner according to claim 38, wherein the THF-insoluble resin component is contained in a proportion of at most 10 wt. % in the binder resin.

40. The toner according to claim 38, wherein the THF-insoluble resin component is substantially zero in the binder resin.

41. The toner according to claim 1 wherein the binder resin shows a molecular weight distribution on a GPC chromatogram of its tetrahydrofuran (THF)-soluble resin content including 2 to 15% of the resin component in a molecular weight region of at most 5,000 and 5 to 30% of the resin component in a molecular weight region of at least $5\times10^6$.

* * * * *

UNITED STATES PATENT AND TRADEMARK OFFICE

CERTIFICATE OF CORRECTION

PATENT NO. : 5,268,248

DATED : December 7, 1993

INVENTOR(S) : HIROHIDE TANIKAWA, ET AL.

It is certified that error appears in the above-identified patent and that said Letters Patent is hereby corrected as shown below:

COLUMN 1

Line 14, "electrophoto-graphic" should read --electrophotographic--.

COLUMN 3

Line 60, "Meltsticking" should read --Melt-sticking--.
Line 66, "excess" should read --a-- and "a toner" should read --excess toner--.
Line 68, "adopt" should read --to adopt--.

COLUMN 4

Line 44, "desired" should read --designed--.

COLUMN 5

Line 21, "a" should read --an--.

COLUMN 6

Line 67, "5 wt. % most" should read --5 wt. %, most--.

COLUMN 7

Line 24, "G4000H (HXL)," should read --G4000H ($H_{XL}$),--.

COLUMN 9

Line 41, "104" should read --$10^4$--.
Line 45, "5000 ∝ $10^5$." should read --5000 - $10^5$.--.
Line 63, "104" should read --$10^4$--.

--

UNITED STATES PATENT AND TRADEMARK OFFICE

CERTIFICATE OF CORRECTION

PATENT NO. : 5,268,248

DATED : December 7, 1993

INVENTOR(S) : HIROHIDE TANIKAWA, ET AL.

It is certified that error appears in the above-identified patent and that said Letters Patent is hereby corrected as shown below:

COLUMN 10

Line 49, "bly" should read --bly have--.

COLUMN 11

Line 17, "developing" should read --developing characteristic--.

COLUMN 17

Line 38, "di-tertbutylsalicylic" should read --di-tert-butylsalicylic--.
Line 60, "Ni/Mn" should read --Ni, Mn,--.
Line 66, "atoms;" should read --atoms);--.

COLUMN 19

Line 32, "[II]impart" should read --[II] impart--.
Line 47, "Ni/Mn" should read --Ni, Mn--.
Line 55, "(" should be deleted and "an alkyl" should be deleted.

COLUMN 20

Line 7, "hydrogen/," should read --hydrogen, alkyl,--.

COLUMN 21

Line 4, "quarternary" should read --quaternary--.
Line 7, "honologo" should read --homologs--.
Line 54, "lowmolecular" should read --low-molecular--.

--

UNITED STATES PATENT AND TRADEMARK OFFICE

CERTIFICATE OF CORRECTION

PATENT NO. : 5,268,248

DATED : December 7, 1993

INVENTOR(S) : HIROHIDE TANIKAWA, ET AL.

It is certified that error appears in the above-identified patent and that said Letters Patent is hereby corrected as shown below:

COLUMN 25

Line 1, "suspension" should read --Suspension--.
Line 32, "into the reaction required," should be deleted.
Line 62, "for" should read --from--.
Line 63, "into the reaction required," should be deleted.

COLUMN 29

Line 33, "over pulveri-" should read --over-pulveri- --.
Line 35, "sultant" should read --sulted--.

COLUMN 30

Line 9, "resulting" should read --result in--.
TABLE 3, "5,000-10,000" should read --5,000-100,000--.

COLUMN 31

TABLE 6, "Melting sticking," should read --Melt-sticking,--.
Line 62, "meltsticking" should read --melt-sticking--.

COLUMN 32

Line 10, "has an" should read --has (i) an--.
Line 12, "5'10$^6$" should read --5x10$^6$--.
Line 42, "weight" should read --weight region--.
Line 53, "carboxylic" should read --carboxyl--.

COLUMN 33

Line 2, "2-100 kgKOH/g." should read --2-100 mgKOH/g.--.
Line 48, "Wherein" should read --wherein--.

--

UNITED STATES PATENT AND TRADEMARK OFFICE

CERTIFICATE OF CORRECTION

PATENT NO. : 5,268,248

DATED : December 7, 1993

INVENTOR(S) : HIROHIDE TANIKAWA, ET AL.

It is certified that error appears in the above-identified patent and that said Letters Patent is hereby corrected as shown below:

COLUMN 34

Line 7, "consisting" should read --consisting of--.
Line 57, "claim 1" should read --claim 1,--.

Signed and Sealed this

Twenty-seventh Day of September, 1994

*Attest:*

*Attesting Officer*

Bruce Lehman

BRUCE LEHMAN

*Commissioner of Patents and Trademarks*

--